US010802436B2

(12) United States Patent
Nakamura

(10) Patent No.: US 10,802,436 B2
(45) Date of Patent: Oct. 13, 2020

(54) IMAGE HEATING APPARATUS HAVING MOVEABLE COUPLING GEAR TO COUPLE AND DECOUPLE A PHOTOSENSITIVE DRUM

(71) Applicant: CANON KABUSHIKI KAISHA, Tokyo (JP)

(72) Inventor: Takuma Nakamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/451,684

(22) Filed: Jun. 25, 2019

(65) Prior Publication Data

US 2019/0391521 A1 Dec. 26, 2019

(30) Foreign Application Priority Data

Jun. 26, 2018 (JP) ..... 2018-120554

(51) Int. Cl.
*G03G 15/00* (2006.01)
*G03G 15/20* (2006.01)

(52) U.S. Cl.
CPC ..... *G03G 15/757* (2013.01); *G03G 15/20* (2013.01)

(58) Field of Classification Search
CPC ..... G03G 15/757
See application file for complete search history.

(56) References Cited

U.S. PATENT DOCUMENTS 6,173,141 B1 * 1/2001 Sakagami ..... G03G 15/0194 399/167
2015/0268614 A1 * 9/2015 Kiyama ..... F16H 7/18 399/167

FOREIGN PATENT DOCUMENTS

JP 2009075268 A 4/2009

* cited by examiner

*Primary Examiner* — Snadra Brase
(74) *Attorney, Agent, or Firm* — Venable LLP

(57) ABSTRACT

Disclosed is an image forming apparatus having moving means for moving a coupling gear between a coupling position where a drum side coupling portion and a main body side coupling portion are coupled to each other and a decoupling position where the drum side coupling portion and the main body side coupling portion are decoupled from each other. The moving means moves the coupling gear to the coupling position when forming a color image, and moves the coupling gear to the decoupling position when forming a monochrome image. The coupling gear has a main body side gear portion which meshes with the main body gear. The coupling gear is integrally molded with the main body side coupling portion and the main body side gear portion.

15 Claims, 10 Drawing Sheets

IMAGE HEATING APPARATUS HAVING MOVEABLE COUPLING GEAR TO COUPLE AND DECOUPLE A PHOTOSENSITIVE DRUM

BACKGROUND OF THE INVENTION

Field of the Invention

The present invention relates to an image forming apparatus such as an electro-photographic copying machine and an electro-photographic printer.

Description of the Related Art

It is known that a conventional electro-photographic image forming apparatus has the configuration which transmits a rotational driving force of a driving source to the photosensitive member by coupling a driving source side coupling to a photosensitive member side coupling in order to rotate the photosensitive member.

Further, Japanese Laid-Open Patent Application Publication No. 2009-75268 discloses the configuration in which the driving source side coupling is coupled to the photosensitive member side coupling or the driving source side coupling is decoupled from the photosensitive member side coupling according to the selection between a color mode and a monochrome mode. Specifically, the driving source side coupling is coupled to the photosensitive member side coupling or the driving source side coupling is decoupled from the photosensitive member side coupling by the driving source side coupling being placed close to the photosensitive member side coupling or by the driving source side coupling being separated from the photosensitive member side coupling, respectively. As a result, the photosensitive members of the respective colors are rotated by a single motor in order to reduce the cost, and the photosensitive members for color are not rotated in the monochrome mode in order to suppress the abrasion of the photosensitive members for color.

There exists a following problem for the configuration disclosed in which the driving source side coupling is coupled to the photosensitive member side coupling or the driving source side the coupling is decoupled from the photosensitive member side coupling according to the selection between a color mode and a monochrome mode as disclosed in Japanese Laid-Open Patent Application Publication No. 2009-75268.

That is, in decoupling the driving source side coupling from the photosensitive member side coupling, when the driving source side coupling is separated from the photosensitive member side coupling, the driving source side coupling may be inclined due to the driving source side coupling being insufficiently supported by the photosensitive member side coupling as depicted in FIG. 10. When the driving source side coupling rotates with being inclined, the meshing portion in which the gear portion of the meshing portion meshing with another gear becomes out of alignment, causing aggravation of the rotational accuracy and generation of an abnormal sound due to a failure of the meshing.

SUMMARY OF THE INVENTION

A representative configuration of the image forming apparatus of the present invention includes:

a main body of the image forming apparatus;

a first drum cartridge which has a first photosensitive drum on which a color toner image is formed, the first drum cartridge being configured to be attached to the main body by being moved and inserted into the main body from an outside of the main body in a direction of a rotational axis of the first photosensitive drum;

a second drum cartridge which has a second photosensitive drum on which a black toner image is formed, the second drum cartridge being configured to be attached to the main body by being moved and inserted into the main body from an outside of the main body in the direction of the rotational axis;

a driving source provided in the main body, the driving source being configured to generate a driving force for rotating the first photosensitive drum and the second photosensitive drum;

a main body gear provided in the main body, the main body gear being configured to transmit the driving force from the driving source to the first drum cartridge, the main body gear being configured to rotate by the driving force;

a coupling gear which is integrally molded with a main body side coupling portion and a main body side gear portion, the main body side coupling portion being configured to be coupled to a drum side coupling portion of the first drum cartridge, the main body side gear portion being configured to mesh with the main body gear, the coupling gear being configured to rotate by the driving force being transmitted from the driving source to the main body side gear portion via the main body side gear; and moving means for moving the coupling gear to a coupling position where the drum side coupling portion and the main body side coupling portion are coupled to each other and to a decoupling position where the drum side coupling portion and the main body side coupling portion are decoupled from each other, wherein when a color image is formed, the moving means moves the coupling gear to the coupling position and when a monochrome image is formed, the moving means moves the coupling gear to the decoupling position.

Further features of the present invention will become apparent from the following description of exemplary embodiments with reference to the attached drawings.

DESCRIPTION OF THE EMBODIMENTS

First Embodiment

<Image Forming Apparatus>

Hereinafter, the overall configuration of the image forming apparatus according to the first embodiment of the present invention will be described together with the operation during an image formation with reference to the drawings. The dimensions, materials, shapes, relative arrangements, and the like of the components described below are not intended to limit the scope of the present invention to them unless otherwise specified.

The image forming apparatus according to the present embodiment is of an electro-photographic type. In the image forming apparatus, the toners of four colors of yellow Y, magenta M, cyan C, and black K are transferred onto an intermediate transfer belt, and then an image is transferred onto a sheet to form an image. In the following description, members using the toners of the above colors are basically suffixed with Y, M, C, and K, respectively. However, when differentiation of the members using the suffixes Y, M, C, and K is not necessary, these suffixes will be appropriately omitted since the configuration and the operation of each member are substantially the same as those of the other members except for the color of the toner.

Figure 1:
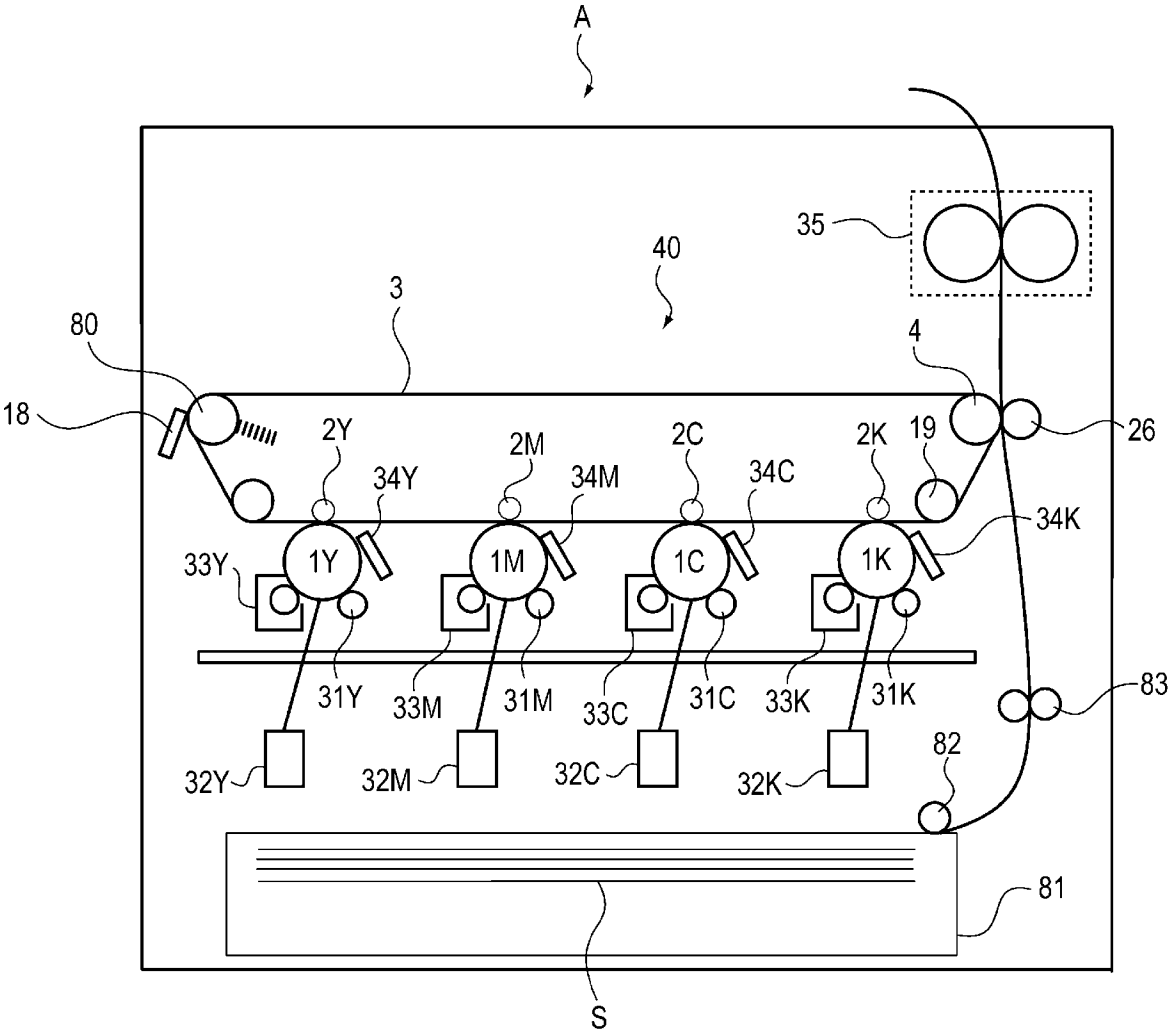
FIG. 1 is a schematic cross sectional view of an image forming apparatus.

As shown in FIG. 1, the image forming apparatus A includes an image forming portion which transfers a toner image to a sheet to form an image, a sheet feeding portion which supplies the sheet to the image forming portion, and a fixing portion which fixes the toner image on the sheet.

The image forming portion includes the photosensitive drums 1 (1Y, 1M, 1C, and 1K), the charging rollers 31 (31Y, 31M, 31C, and 31K) which charges the surface of the photosensitive drums 1, the developing devices 33 (33Y, 33M, 33C, and 33K), the primary transfer rollers 2 (2Y, 2M, 2C, and 2K), the laser scanner units 32 (32Y, 32M, 32C, and 32K), the drum cleaners 34 (34Y, 34M, 34C, and 34K), and the intermediate transfer unit 40.

The intermediate transfer unit 40 includes the intermediate transfer belt 3, the secondary transfer roller 26, the secondary transfer counter roller 4, the steering roller 80, the tension roller 19, and the belt cleaner 18. The intermediate transfer belt 3 (intermediate transfer member) is an endless belt stretched around the secondary transfer counter roller 4, the steering roller 80, the tension roller 19 and the like. The intermediate transfer belt 3 is rotated by the rotation of the secondary transfer counter roller 4 which is driven by the driving source.

Next, the image forming operation will be described. When the control portion (not shown) receives an image forming job signal, the sheet S stacked and stored on the sheet stacking portion 81 is sent by the feeding roller 82 and the conveying roller 83 to the secondary transfer portion configured by the secondary transfer roller 26 and the secondary transfer counter roller 4.

On the other hand, in the image forming portion, firstly, the surface of the photosensitive drum 1 is uniformly charged by the charging roller 31. Thereafter, the laser scanner unit 32 irradiates the surface of the photosensitive drum 1 of each color with a laser beam generated by a light source (not shown) according to the image data transmitted from an external device (not shown) or the like so that an electrostatic latent image is formed on the surface of the photosensitive drum 1.

Thereafter, toners of respective colors are attached to the electrostatic latent image formed on the surface of the photosensitive drum 1 by the developing device 33 to form a toner image on the surface of the photosensitive drum 1. The toner image formed on the surface of the photosensitive drum 1 is primarily transferred onto the intermediate transfer belt 3 by applying a primary transfer bias to the primary transfer roller 2. As a result, a full color toner image is formed on the surface of the intermediate transfer belt 3.

Thereafter, as the intermediate transfer belt 3 rotates, the toner image is sent to the secondary transfer portion. Then, at the secondary transfer portion, a secondary transfer bias is applied to the secondary transfer roller 26 so that the toner image on the intermediate transfer belt 3 is transferred onto the sheet S.

That is, the photosensitive drums 1Y, 1M, and 1C (examples of the first photosensitive drum) each bear a color toner image, and the photosensitive drum 1K (an example of the second photosensitive drum) bears a black toner image. The primary transfer rollers 2Y, 2M, 2C (first transfer members) transfer the toner images born on the photosensitive drums 1Y, 1M, 1C onto the intermediate transfer belt 3, and the primary transfer roller 2K (second transfer member) transfers the toner image born on the photosensitive drum 1K onto the intermediate transfer belt 3. The toner images born on the photosensitive drum 1 are temporarily transferred onto the intermediate transfer belt 3.

Next, the sheet S on which the toner image has been transferred is heated and pressurized at the fixing device 35, whereby the toner image on the sheet S is fixed to the sheet S. Thereafter, the sheet S on which the toner image is fixed is discharged to a discharge portion (not shown).

The toner attached to the surface of the photosensitive drum 1 after the primary transfer is scraped off and removed by the drum cleaner 34. On the other hand, the toner attached to the intermediate transfer belt 3 after the secondary transfer is scraped off and removed by the belt cleaner 18.

The configuration according to the present embodiment can be similarly applied to an image forming apparatus using a drum cartridge in which the photosensitive drum 1 and the charging rollers 31 and the drum cleaner 34 are integrated and which is to be mounted on the main body of the image forming apparatus A. The drum cartridge can be attached to and detached from the apparatus main body by inserting and pulling out the drum cartridge respectively at the side surface of the main body of the image forming apparatus A. When replacing the photosensitive drum 1, the drum cartridge is removed from the apparatus main body and replaced.

<Full Color Mode and Monochrome Mode>

The image forming apparatus A can execute a full color mode for forming a full color image described above and a monochrome mode for forming a monochrome image using only black toner. Hereinafter, the configuration of the full color mode and the configuration of the monochrome mode will be described.

Figure 2A:
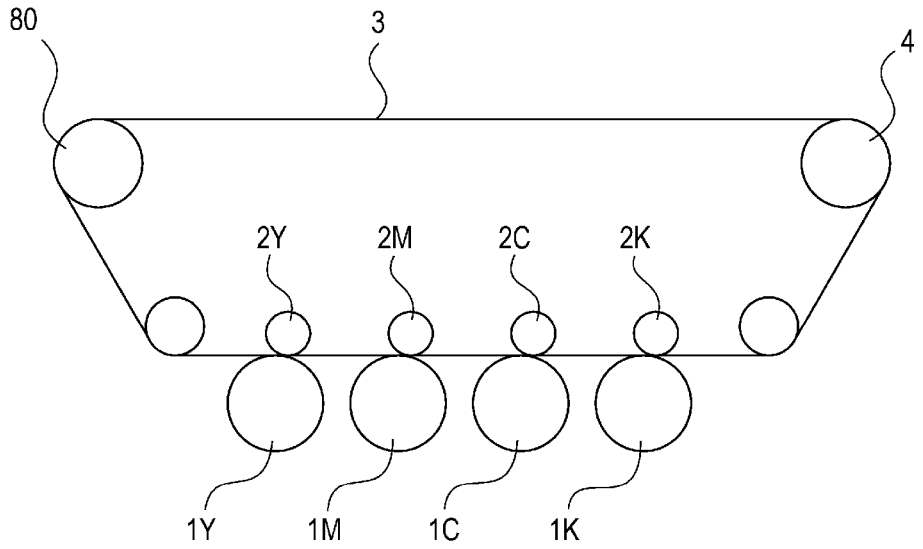
FIGS. 2A and 2B are a schematic view showing a configuration of the image forming portion in each image forming mode.
Figure 2B:
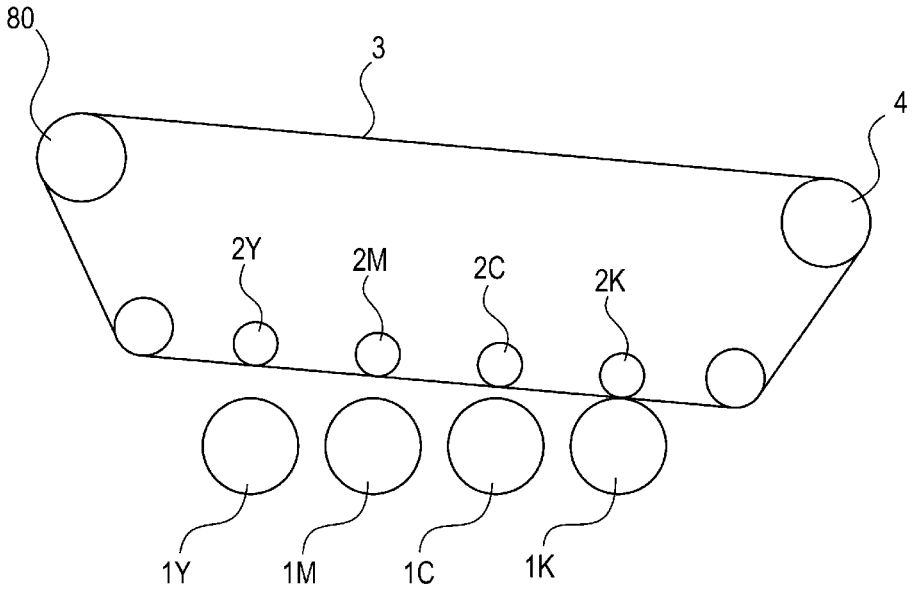

FIGS. 2A and 2B are a schematic view showing the configuration of the image forming portion in each image forming mode. FIG. 2A shows the state of the intermediate transfer unit 40 in the full color mode, and FIG. 2B shows the state of the intermediate transfer unit 40 in the monochrome mode.

As shown in FIG. 2A, in the full color mode, all the photosensitive drums 1 (1Y to 1K) are in contact with the intermediate transfer belt 3. At this time, the intermediate transfer belt 3 is nipped by the primary transfer rollers 2 (2Y to 2K) and the photosensitive drums 1 (1Y to 1K), respectively. That is, in the full color mode, all of the primary transfer rollers 2 (2Y to 2K) and the photosensitive drums 1

(1Y to 1K) abut on the intermediate transfer belt 3. In this state, all of the photosensitive drums 1 (1Y to 1K) and the primary transfer rollers 2 (2Y to 2K) are rotationally driven to form a color image.

As shown in FIG. 2B, in the monochrome mode, the photosensitive drums 1Y to 1C which are not used at the time of image formation do not abut on the intermediate transfer belt 3. Specifically, in the monochrome mode, the intermediate transfer unit 40 is rotated in a direction in which the intermediate transfer unit 40 is moved away from the photosensitive drums 1Y to 1C by the moving mechanism (not shown) with the contact state between the photosensitive drum 1K and the intermediate transfer belt 3 being maintained. As a result, in the monochrome mode, the intermediate transfer belt 3 abuts only on the photosensitive drum 1K out of the four photosensitive drums 1Y to 1K. Only the photosensitive drum 1K and the primary transfer roller 2K are driven to rotate during the image formation in order to form an image on the intermediate transfer belt 3. As a result, the rotation of the photosensitive drums 1Y, 1M and 1C, and the primary transfer rollers 2Y, 2M and 2C which are not used during the image formation can be stopped.

For example, the photosensitive drum 1 always abuts on the drum cleaner 34 when the photosensitive drum 1 is rotated. As a result, the surface of the photosensitive drum 1 is abraded by the drum cleaner 34. As described above, by stopping the rotation of the photosensitive drums 1 which are not used during image formation, the photosensitive drums 1 are not rubbed by the drum cleaner 34 when the photosensitive drums 1 are not used. Thus, consuming the photosensitive drum 1 can be suppressed.

<Driving Portion>

Next, the configuration of the driving portion for driving the photosensitive drum 1 will be described.

Figure 3:
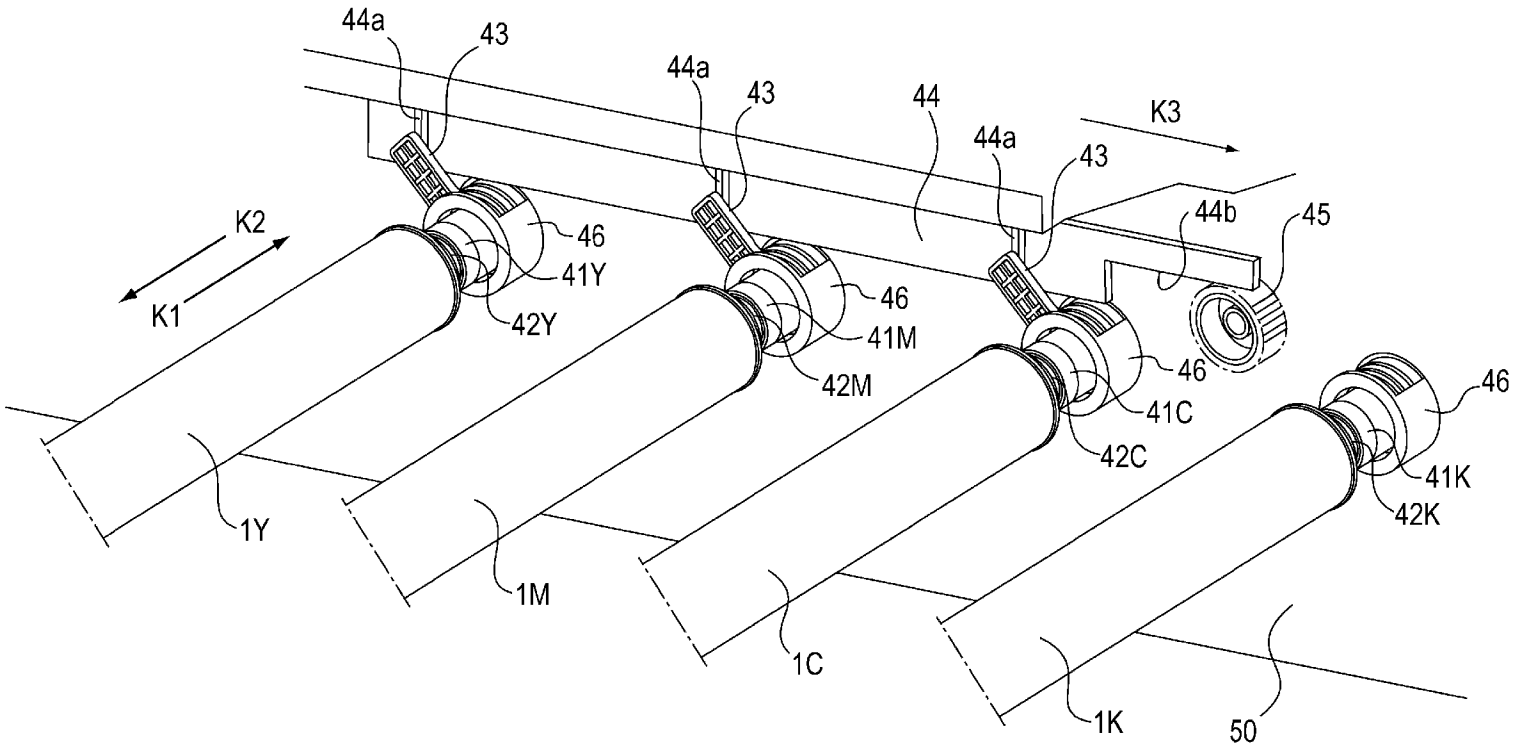
FIG. 3 is a perspective view of a driving portion which drives a photosensitive drum.
Figure 4:
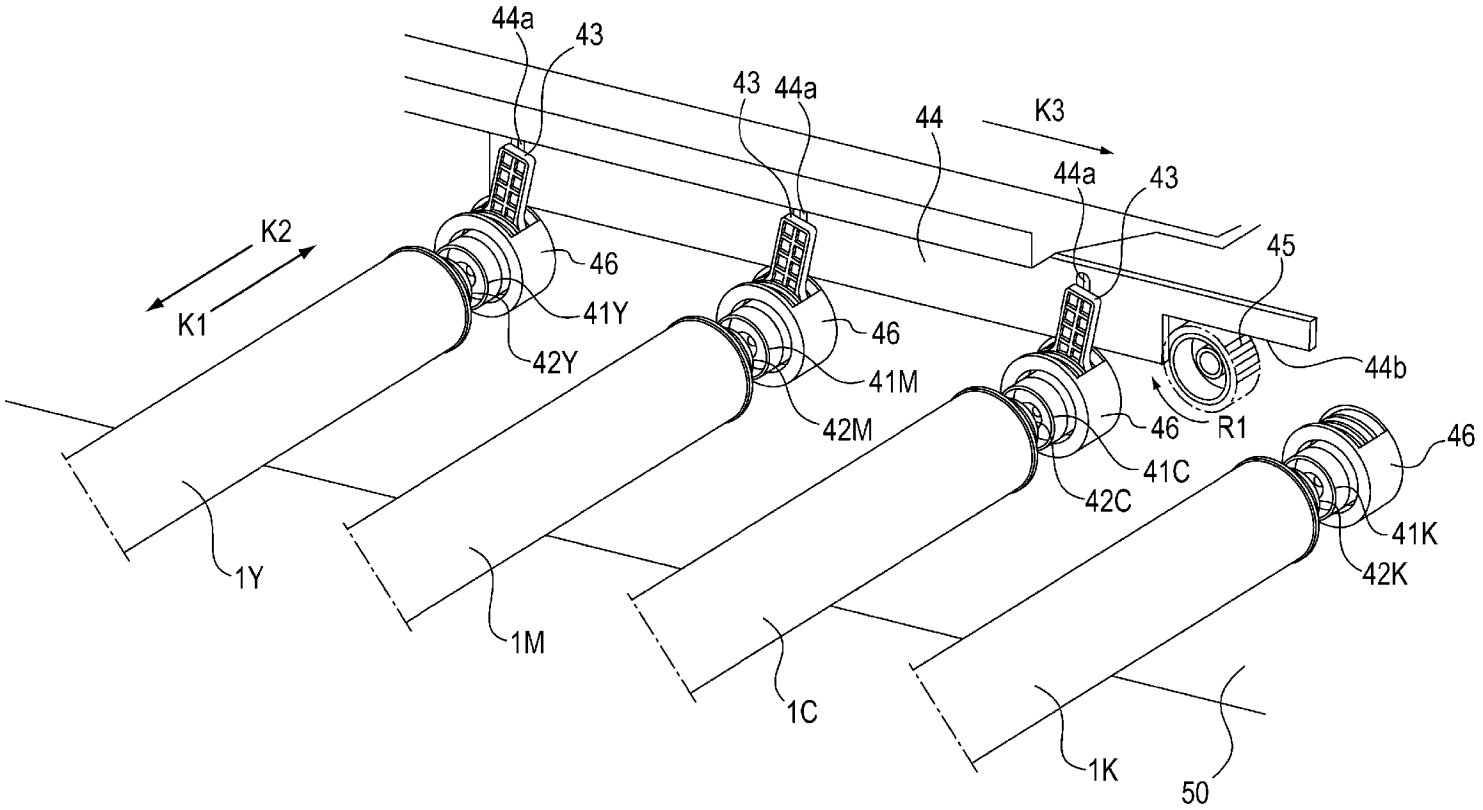
FIG. 4 is a perspective view of a driving portion which drives the photosensitive drum.

FIGS. 3 and 4 are a perspective view of a driving unit for driving the photosensitive drum 1. In the following description, in order to simplify the description, the photosensitive drums 1Y to 1C will be referred to as a color photosensitive drum as well and the photosensitive drum 1K will be referred to as a monochrome photosensitive drum as well.

FIG. 3 shows the driving portion in the state in which the photosensitive member couplings 42Y to 42C (described later, an example of a drum side coupling portion) provided on the photosensitive drums 1Y to 1C, which are color photosensitive drums, are coupled to the gear couplings 41Y to 41C (described later, an example a coupling gear), respectively. In this state, when a motor (not shown) as a driving source is driven, the driving force of the motor is transmitted to the photosensitive drums 1Y to 1K. That is, all the photosensitive drums 1Y to 1K rotate in response to the driving of the driving source. This state is referred to as a color mode. In the color mode for forming a color image, all the photosensitive member couplings 42Y to 42K (described later) are coupled to the gear couplings 41Y to 41K (described later), respectively.

FIG. 4 shows the driving portion in the state in which the photosensitive member couplings 42Y to 42C (described later) provided on the color photosensitive drums are decoupled from the gear couplings 41Y to 41C (described later), respectively. In this state, even if a motor (not shown) is driven, the driving force of the motor is not transmitted to the photosensitive drums 1Y to 1C which are color photosensitive drums. That is, only the photosensitive drum 1K, which is a monochrome photosensitive drum, rotates in response to the driving of the driving source. This state is referred to as a monochrome mode. In the monochrome mode for forming a monochrome image, none of the photosensitive member couplings 42Y to 42C (described later) are coupled to the gear couplings 41Y to 41C (described later), respectively. The driving force of the driving source is not transmitted to the photosensitive drums 1Y to 1C so that the photosensitive drums 1Y to 1C do not rotate in the monochrome mode. Therefore, it is possible to prevent the photosensitive drums 1Y to 1C, which are color photosensitive drums, from being rubbed by the drum cleaners 34Y to 34C in the monochrome mode. Thus, the life of the photosensitive drums 1Y to 1C can be prevented from being shortened by the rubbing with the drum cleaners 34Y to 34C.

Next, the photosensitive member coupling 42 and the gear coupling 41 will be described. Hereinafter, the description of the photosensitive member couplings 42Y to 42C and the gear couplings 41Y to 41C for the color photosensitive drums and the description of the photosensitive member coupling 42K and the gear coupling 41K for the monochrome photosensitive drum will be separately made.

Firstly, the photosensitive member couplings 42Y to 42C and the gear couplings 41Y to 41C will be described. Since each of the configurations of the stations Y, M and C is the same as those of the other stations, the photosensitive member coupling 42Y and the gear coupling 41Y will be described as an example. As shown in FIGS. 3 and 4, the photosensitive member coupling 42Y is press-fitted and attached to an end portion of the photosensitive drum 1Y in the direction of the rotational axis of the photosensitive drum 1Y. Further, in the state where the photosensitive drum 1Y is attached to the image forming apparatus A, the gear coupling 41Y to be coupled to the photosensitive member coupling 42Y is provided in the vicinity of the photosensitive member coupling 42Y.

Specifically, the gear coupling 41Y is provided on the side plate 50 disposed on the back side of the image forming apparatus A. When the photosensitive drum 1Y is attached to the image forming apparatus A, the photosensitive member coupling 42Y engages with the gear coupling 41Y. In this case, it is not necessary for the photosensitive member coupling 42Y to mesh with the gear coupling 41Y, and it suffices that the photosensitive member coupling 42Y is in contact with the gear coupling 41Y. For example, at this state, the gear coupling 41Y is driven to rotate by the driving source, and the photosensitive member coupling 42Y may be coupled to the gear coupling 41Y by this rotation.

The gear coupling 41Y is a member in which the gear portion 41*a* and the coupling portion 41*b* are integrally formed, and the main body gear 210 meshes with the gear portion 41*a* (see FIG. 5). The gear coupling 41 is urged in the direction of the arrow K2 shown in FIGS. 3 to 5 by the spring 51 (see FIG. 8). The gear coupling 41 rotates by receiving a rotational driving force of a motor (not shown) as a driving source via the gear portion 41*a* and another gear (not shown) to transmit the rotational driving force to the photosensitive member coupling 42. As a result, the photosensitive drum 1Y rotates.

<Switching Configuration between Coupling and Decoupling States>

Next, the configuration for switching between the coupling state and a decoupling state between the gear couplings 41Y, 41M and 41C, and the photosensitive member couplings 42Y, 42M and 42C will be described. In the following description, only the configuration for switching between the coupling state and the decoupling state between the gear coupling 41Y and the photosensitive member coupling 42Y will be described since the configurations of the gear couplings 41M and 41C are the same as that of the gear coupling 41Y and the configurations of the photosensitive member couplings 42M and 42C are the same as that of the photosensitive member coupling 42Y.

As shown in FIGS. 3 and 4, the slider 44 is provided in the vicinity of the gear couplings 41Y to 41C. The slider 44 is a rectangular plate and can slide along the direction in which the photosensitive drums 1Y to 1K are arranged. The rack gear portion 44*b* is formed on one end of the slider 44 in the longitudinal direction of the slider 44. The slider driving gear 45 is provided for example on the side plate 50 in the vicinity of the rack gear portion 44*b* such that the slider driving gear 45 is rotatably fixed to the image forming apparatus A. The slider driving gear 45 meshes with the rack gear portion 44*b* so that the slider 44 slides interlocking with the rotation of the slider driving gear 45.

The side plate 50 is provided in the vicinity of the slider 44. Further, the cam holder 46 (holding member) is attached and fixed to the side plate 50. The cam holder 46 encloses and holds the cam link 43 (abutting member). The cam link 43 is provided so as to abut on the gear coupling 41Y. The boss portion 43*a* (see FIG. 7) which is a part of the cam link 43 protrudes from the cam holder 46, and engages the engaging groove 44*a* formed on the slider 44. The cam link 43 is not provided on the gear coupling 41K.

Figure 5A:
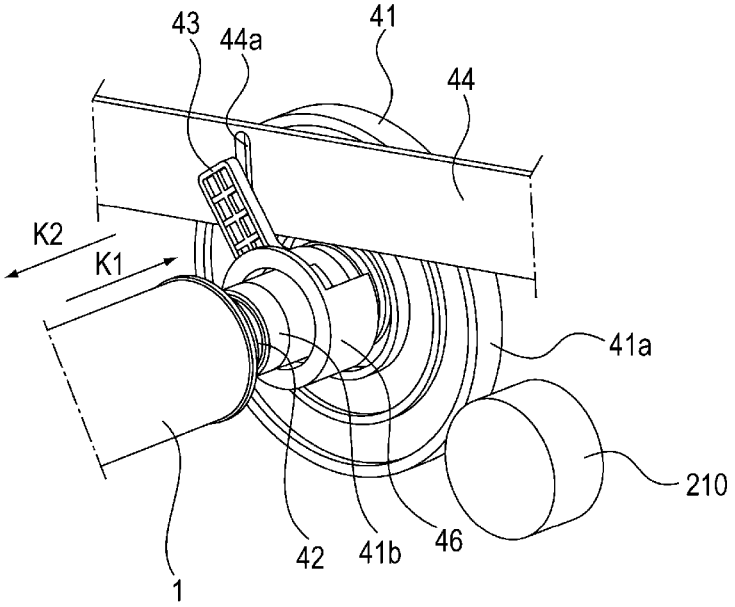
FIGS. 5A and 5B are an enlarged perspective view of a gear coupling and a coupling for transmitting a rotational driving force to the photosensitive drum.
Figure 5B:
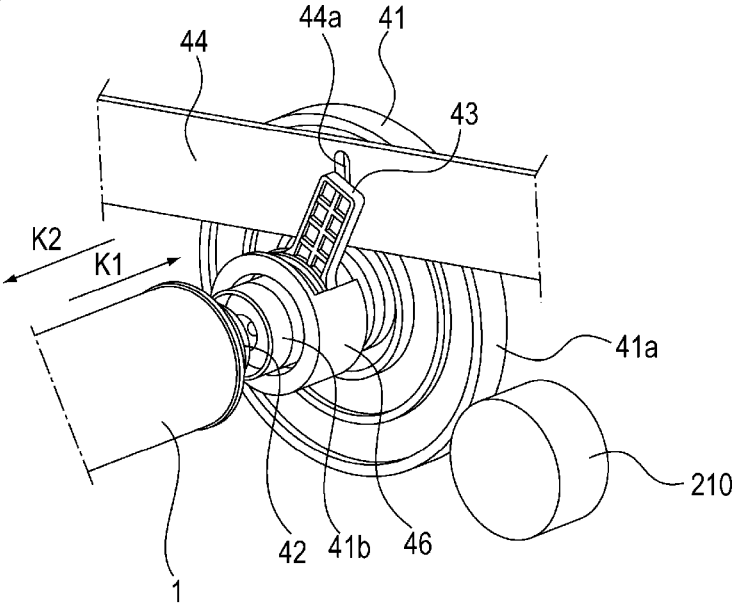

With reference to FIG. 5, the configuration for coupling and decoupling operations between the photosensitive member coupling 42 and the gear coupling 41 in response to the slide movement of the slider 44 will be described in detail. FIGS. 5A and 5B are an enlarged view of the coupling portion between the color photosensitive drum and the corresponding gear coupling 41. FIG. 5A shows the configuration of the coupling portion in the color mode and FIG. 5B shows the configuration of the coupling portion in the monochrome mode.

As shown in FIG. 5A, the engaging groove 44*a* is formed on the slider 44. The boss portion 43*a* (see FIG. 7) formed on the cam link 43 is fitted in the engaging groove 44*a*. Thus, the cam link 43 rotates interlocking with the slide movement of the slider 44. Specifically, as shown in FIG. 4, when the slider driving gear 45 rotates in the direction of the arrow R1, the slider 44 slides in the direction of the arrow K3. By this, as shown in FIG. 5A, the cam link 43 rotates clockwise, resulting in the state shown in FIG. 5B.

Figure 6:
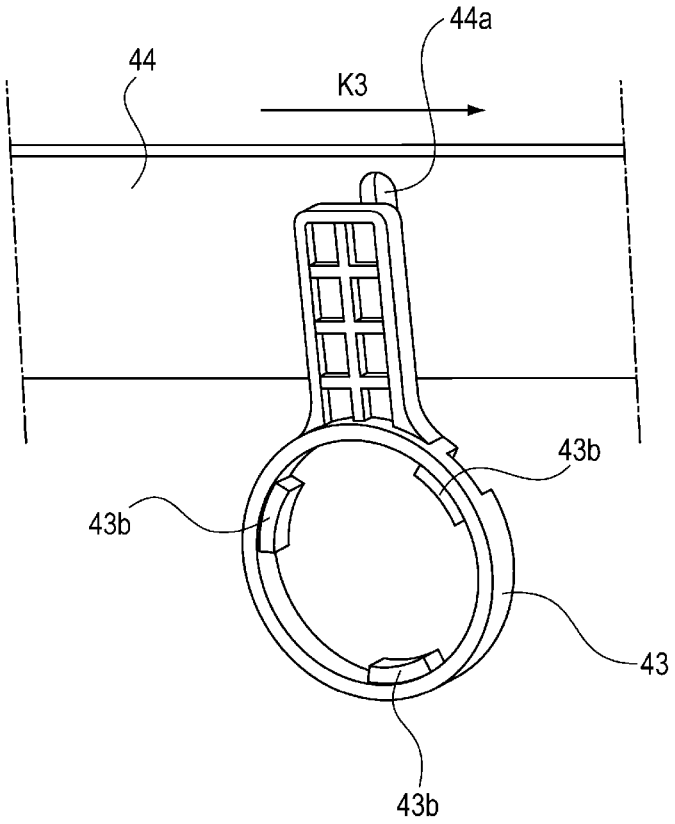
FIG. 6 is a perspective view of a slider and a cam link.

FIG. 6 is a perspective view of the slider 44 and the cam link 43. As shown in FIG. 6, the cam portion 43*b* is formed on the inner circumferential surface of the cam link 43 so as to protrude toward the center of the rotation of the cam link 43.

When decoupling the gear coupling 41Y from the photosensitive member coupling 42Y, the slider driving gear 45 is rotated in the direction of the arrow R1 shown in FIG. 4 by receiving a rotational driving force of a motor (not shown). As a result, the rotational driving force is transmitted to the rack gear portion 44*b* of the slider 44 so that the slider 44 moves in the direction of the arrow K3 shown in FIG. 4.

Figure 7:
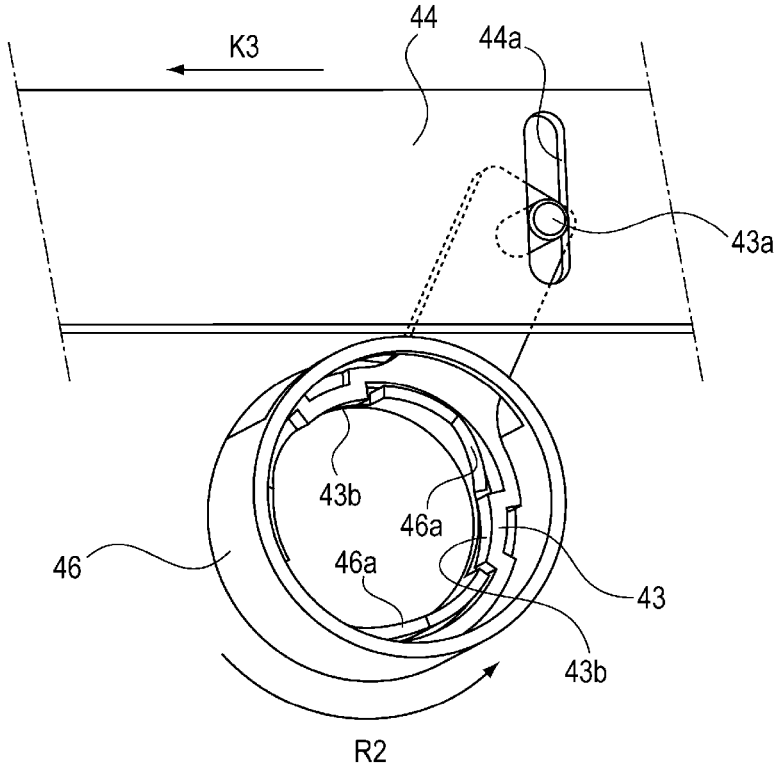
FIG. 7 is a perspective view of the slider, the cam link and a cam holder.

Next, as shown in FIG. 7, when the boss portion 43*a* of the cam link 43 moves in the direction of the arrow K3 as the slider 44 moves in the same direction, the cam link 43 rotates in the direction of the arrow R2. As the cam link 43 rotates, the cam portion 43*b* moves along the cam surface 46*a* which is a slope of the cam holder 46 while rotating in the same direction. As a result, the cam link 43 moves in the thrust direction (the direction of the arrow K1 shown in FIG. 4) while pressing the gear coupling 41Y, thereby separating the gear coupling 41Y from the photosensitive member coupling 42Y to decouple the gear coupling 41Y from the photosensitive member coupling 42Y. In the present embodiment, the gear coupling 41Y is separated from the photosensitive member coupling 42Y by about 3 mm in the thrust direction.

When coupling the gear coupling 41Y to the photosensitive member coupling 42Y, the motor (not shown) is reversely rotated so that the slider driving gear 45 is rotated in the direction opposite to the arrow R1 shown in FIG. 4. As a result, a rotational driving force is transmitted to the rack gear portion 44*b* of the slider 44 so that the slider 44 moves in the direction opposite to the direction of the arrow K3 shown in FIG. 4.

Next, as the slider 44 moves, the cam link 43 rotates in the direction opposite to the direction of the arrow R2 shown in FIG. 7. The cam portion 43*b* moves along the cam surface 46*a* of the cam holder 46 by the rotation of the cam link 43 and the urging force of the spring 51. As a result, the cam link 43 and the gear coupling 41Y move in the direction of the arrow K2 shown in FIG. 4 and the gear coupling 41Y approaches the photosensitive member coupling 42Y so that the gear coupling 41Y is coupled to the photosensitive member coupling 42Y.

That is, the cam link 43, the cam holder 46, and the motor (not shown) function as moving means for moving the gear coupling 41 between the coupling position where the coupling portion 41*b* (an example of a main body side coupling portion) of the gear coupling 41 is coupled to the photosensitive member coupling 42 and the decoupling position where the coupling portion 41*b* is decoupled from the photosensitive member coupling 42 by the coupling portion 41*b* being retracted from the coupling position in the thrust direction. A control portion (not shown) controls the driving of the motor (not shown) for rotating the slider driving gear 45 (and the cam link 43), and controls this moving means.

No matter when the gear coupling 41Y is coupled to the photosensitive member coupling 42Y or when the gear coupling 41Y is decoupled from the photosensitive member coupling 42Y, the gear portion 41*a* (an example of a main body side gear portion) of the gear coupling 41Y meshes with another gear, that is, the main body gear 210, for example. For this reason, when the motor (not shown) rotates in the state where the gear coupling 41Y is decoupled from the photosensitive member coupling 42Y, the gear coupling 41Y rotates and the photosensitive member coupling 42Y does not rotate.

As described above, the photosensitive drums 1Y, 1M and 1C remain in the state where the photosensitive drums 1Y, 1M and 1C do not rotate even when the gear coupling 41 rotates by decoupling the gear couplings 41Y, 41M and 41C from the photosensitive member couplings 42Y, 42M and 42C, respectively in the monochrome mode. Therefore, it is possible to reduce the cost by rotating the photosensitive drums 1 of respective colors by one motor, as well as to suppress the abrasion by making the photosensitive drums 1Y, 1M and 1C for color remain in the state where the photosensitive drums 1Y, 1M and 1C do not rotate in the monochrome mode.

<Support Configuration of Gear Coupling>

Next, the support configuration of the gear couplings 41Y, 41M and 41C will be described. In the following description, only the supporting configuration of the gear coupling 41Y is described since the configuration of the gear couplings 41M and 41C have the same configuration as that of the gear coupling 41Y.

Figure 8:
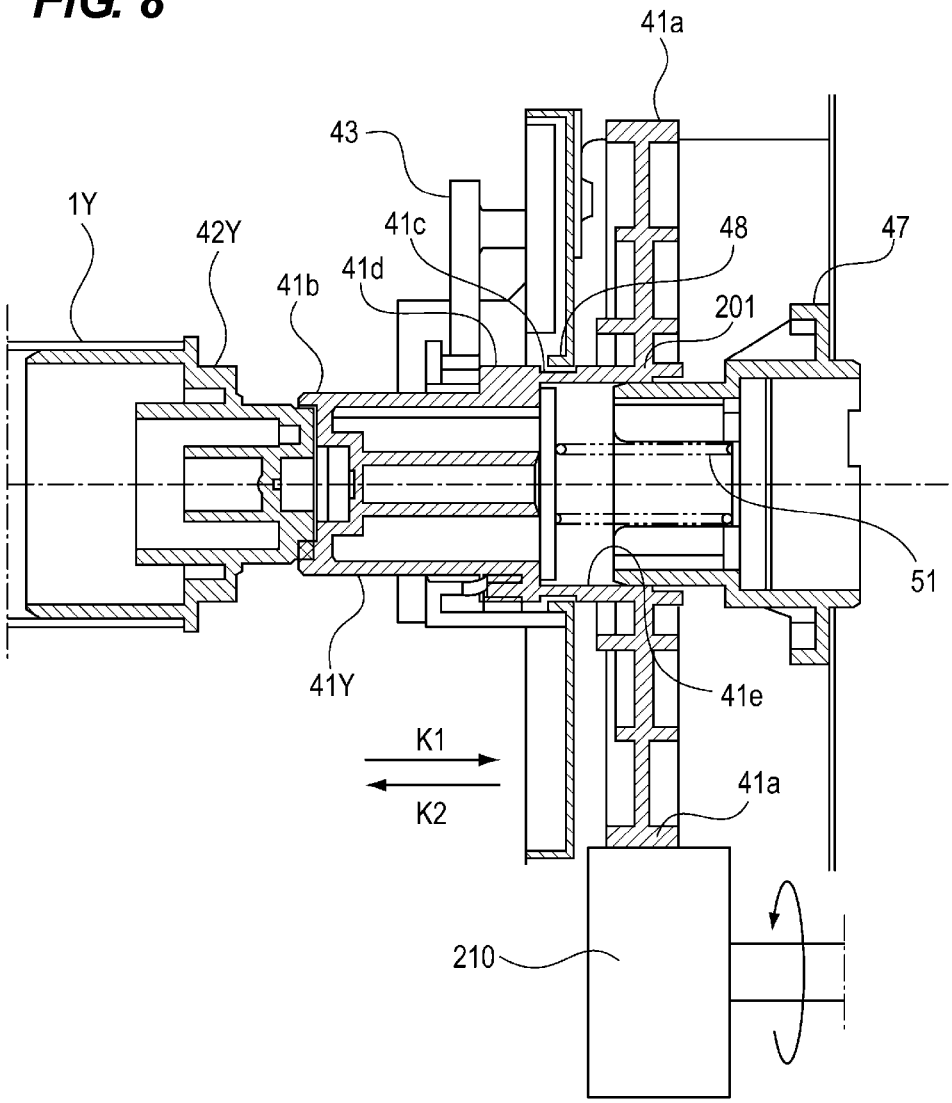
FIG. 8 is a cross sectional view of a gear coupling and a photosensitive member coupling.
Figure 9:
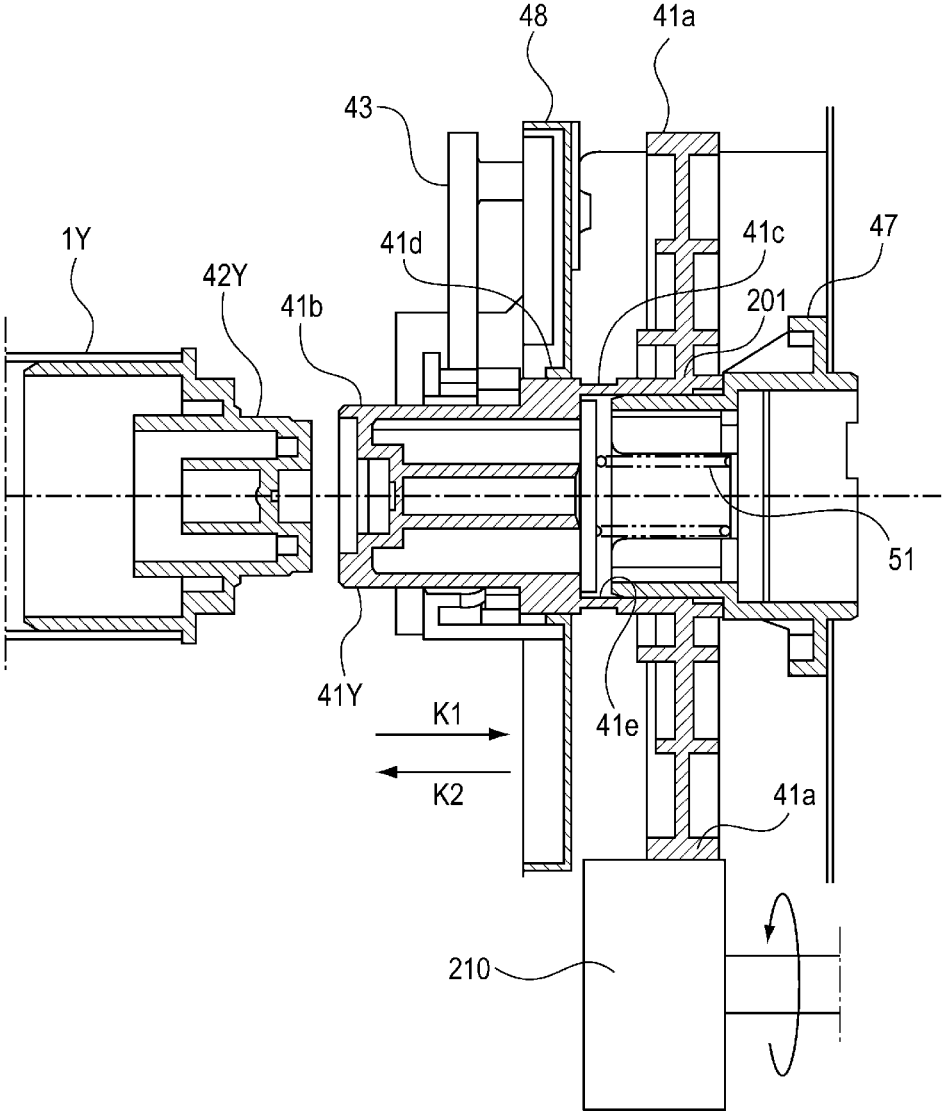
FIG. 9 is a cross sectional view of the gear coupling and the photosensitive member coupling.
Figure 10:
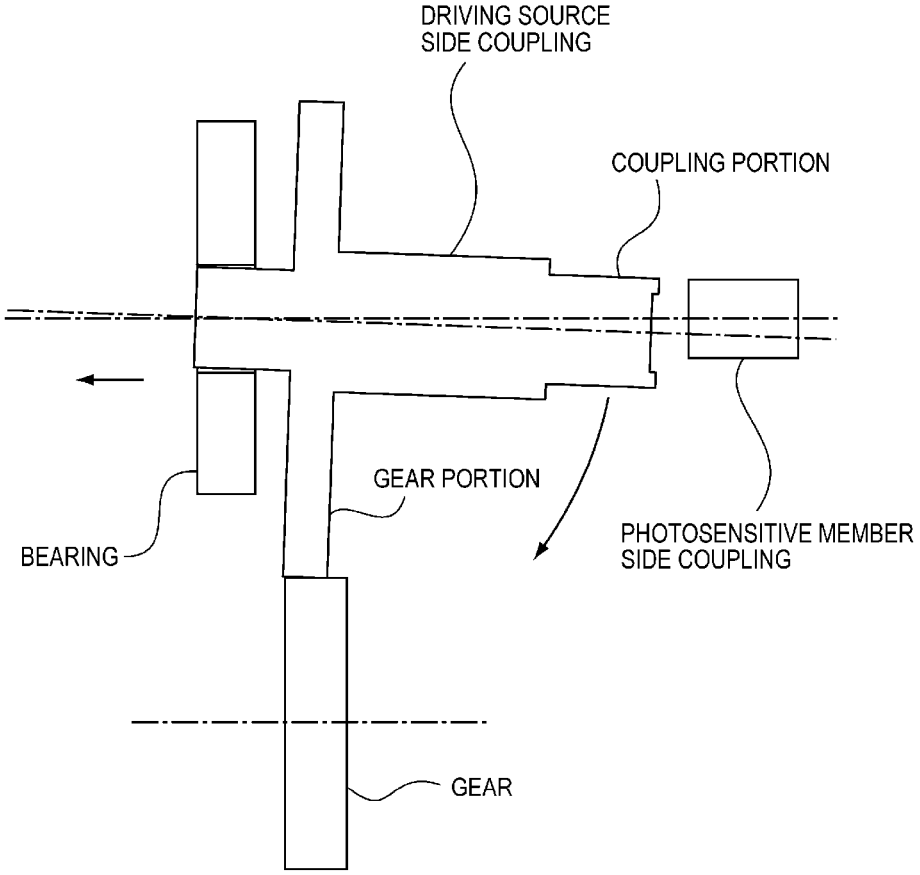
FIG. 10 is a schematic view for explaining a problem of the prior art.

FIGS. 8 and 9 are a cross sectional view of the gear coupling 41Y and the photosensitive member coupling 42Y. FIG. 8 shows the state in which the gear coupling 41Y is coupled to the photosensitive member coupling 42Y, and FIG. 9 shows the state in which the gear coupling 41Y is decoupled from the photosensitive member coupling 42Y.

As shown in FIGS. 8 and 9, the gear coupling 41 is integrally formed with the coupling portion 41*b* and the gear portion 41*a*. In other words, the gear coupling 41 is an integral molding product in which the coupling portion 41*b* and the gear portion 41*a* are integrally mold. When the coupling portion 41*b* and the gear portion 41*a* were separately formed, the rotation center axis of the part corresponding to the coupling portion 41*b* and the rotation center axis of the part corresponding to the gear portion 41*a* might be slightly deviated due to the tolerance between these parts. Further, when the gear coupling 41 was configured by discrete parts, the cost would increase due to an increase in the number of parts.

As shown in FIGS. 8 and 9, the gear portion 41*a* meshes with the main body gear 210. Thus, the driving force for driving the photosensitive drums 1Y to 1C is transmitted from the driving source to the gear portion 41*a* via the main body gear 210. The gear coupling 41 rotates interlocking with the rotation of the main body gear 210.

Here, the gear coupling 41 is moved between the coupling position and the decoupling position by the moving means. Therefore, the gear coupling 41 slides between the coupling position and the decoupling position with the gear portion 41*a* being meshed with the main body gear 210. However, the present invention is not limited to this configuration. For example, the gear portion 41*a* may be decoupled from the main body gear 210 according as the gear coupling 41 moves from the coupling position to the decoupling position.

As shown in FIGS. 8 and 9, the large outer diameter portion 41*d* (first outer circumferential portion) and the small outer diameter portion 41*c* (second outer circumferential portion) having an outer diameter less than that of the large outer diameter portion 41*d* are formed on the outer circumferential portion of the gear coupling 41Y. The gear coupling 41 is rotatably supported by the rear bearing 47 (an example of a first bearing, also referred to as a bearing portion) and the front bearing 48 (second bearing). The rear bearing 47 is fitted in the fitting hole 201 formed on the gear coupling 41Y. The front bearing 48 supports the gear coupling 41 at a position closer to the photosensitive drum 1Y in the thrust direction than that of the rear bearing 47.

As shown in FIG. 8, when the gear coupling 41Y is coupled to the photosensitive member coupling 42Y, the inner circumferential portion 41*e* of the gear coupling 41Y is fitted with the outer circumferential portion of the rear bearing 47 (first bearing), whereby the gear coupling 41 is supported by the rear bearing 47. The tip portion of the gear coupling 41Y is fitted with the photosensitive member coupling 42Y. In this case, the front bearing 48 (second bearing) is located at a position corresponding to the small outer diameter portion 41*c* of the gear coupling 41 (position at which the front bearing 48 overlaps with the small outer diameter portion 41*c* in the direction orthogonal to the thrust direction), and a gap is formed between the front bearing 48 and the small outer diameter portion 41*c*. Therefore, the front bearing 48 is not fitted with the small outer diameter portion 41*c* so that the gear coupling 41 is not supported by the front bearing 48.

As shown in FIG. 9, even when the gear coupling 41Y is decoupled from the photosensitive member coupling 42Y, the inner circumferential portion 41*e* of the gear coupling 41Y is fitted with the outer circumferential portion of the rear bearing 47 so that the gear coupling 41Y is supported by the rear bearing 47 similarly to the case where the gear coupling 41Y is coupled to the photosensitive member coupling 42Y. However, the gear coupling 41Y is located at a position where the gear coupling 41Y is retracted from the photosensitive member coupling 42Y in the direction of the arrow K1 and the tip portion of the gear coupling 41Y is not fitted with the photosensitive member coupling 42. As a result, the gear coupling 41Y is not supported by the photosensitive member coupling 42.

On the other hand, the front bearing 48 is located at a position corresponding to the large outer diameter portion 41*d* of the gear coupling 41Y (at a position where the front bearing 48 overlaps with the large outer diameter portion 41*d* in the direction orthogonal to the thrust direction). Further, the large outer diameter portion 41*d* is fitted with the front bearing 48. As a result, the gear coupling 41 is supported by the front bearing 48. That is, according as the gear coupling 41Y moves from the coupling position where the gear coupling 41Y is coupled to the photosensitive member coupling 42Y to the decoupling position where the gear coupling 41Y is decoupled from the photosensitive member coupling 42Y, the front bearing 48 gets fitted to the large outer diameter portion 41*d* so that the gear coupling 41 is supported by the front bearing 48.

As described above, by supporting the gear coupling 41 with the front bearing 48 when the gear coupling 41 is decoupled from the photosensitive member coupling 42, the gear coupling 41 is suppressed from being tilted. Therefore, it is possible to suppress a failure in the meshing between the gear coupling 41 and another gear (not shown) at the meshing portion, which enables to suppress the deterioration of the rotational accuracy and the generation of abnormal sound when the gear coupling 41 rotates.

Further, when the gear coupling 41 is coupled to the photosensitive member coupling 42, the front bearing 48 does not support the gear coupling 41. That is, the gear coupling 41 is not supported at the three points of the rear bearing 47, the front bearing 48 and the photosensitive member coupling 42. As a result, it is possible to suppress the occurrence of poor fitting between the members due to the influence of tolerance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-120554, filed Jun. 26, 2018, which is hereby incorporated by reference herein in its entirety.

What is claimed is:

1. An image forming apparatus, comprising:

a main body of the image forming apparatus;

a first drum cartridge which has a first photosensitive drum on which a color toner image is formed, the first drum cartridge being configured to be attached to the main body by being moved and inserted into the main body from an outside of the main body in a direction of a rotational axis of the first photosensitive drum;

a second drum cartridge which has a second photosensitive drum on which a black toner image is formed, the second drum cartridge being configured to be attached to the main body by being moved and inserted into the main body from an outside of the main body in the direction of the rotational axis;

a driving source provided in the main body, the driving source being configured to generate a driving force for rotating the first photosensitive drum and the second photosensitive drum;

a main body gear provided in the main body, the main body gear being configured to transmit the driving force from the driving source to the first drum cartridge, the main body gear being configured to rotate by the driving force;

a coupling gear including a main body side coupling portion, the main body side coupling portion having a main body gear portion intergrally molded with the main body side coupling portion, the main body side coupling portion being configured to be coupled to a drum side coupling portion of the first drum cartridge, the main body gear portion being configured to mesh with the main body gear, the coupling gear being configured to rotate by the driving force being transmitted from the driving source to the main body gear portion via the main body gear; and a moving unit configured to move the coupling gear to a coupling position where the drum side coupling portion and the main body side coupling portion are coupled to each other and to a decoupling position where the drum side coupling portion and the main body side coupling portion are decoupled from each other, wherein when a color image is formed, the moving unit moves the coupling gear to the coupling position and when a monochrome image is formed, the moving unit moves the coupling gear to the decoupling position.

2. The image forming apparatus according to claim 1, wherein the coupling gear is moved between the coupling position and decoupling position in the direction of the rotational axis of the first photosensitive drum by the moving unit.

3. The image forming apparatus according to claim 1, wherein the main body gear portion is formed on an outer circumferential surface of the coupling gear.

4. The image forming apparatus according to claim 1, wherein the coupling gear is configured to be fitted to a bearing portion provided in the main body and to rotate around the bearing portion as a rotational center.

5. The image forming apparatus according to claim 4, wherein the coupling gear comprises:

a first outer circumferential portion provided between the main body gear portion and the main body side coupling portion in the direction of the rotational axis of the first photosensitive drum; and a second outer circumferential portion provided between the main body gear portion and the main body side coupling portion in the direction of the rotational axis, an outer diameter of the second outer circumferential portion being less than that of the first outer circumferential portion, wherein the image forming apparatus further comprises an abutting portion provided in the main body, the abutting portion being configured to restrict a movement of the coupling gear in a direction orthogonal to the direction of the rotational axis of the first photosensitive drum by abutting on the first outer circumferential portion when the coupling gear is located at the decoupling position, and wherein when the coupling gear is located at the coupling position, the abutting portion and the second outer circumferential portion are positioned such that the abutting portion overlaps with the second outer circumferential portion in a direction orthogonal to the direction of the rotational axis of the first photosensitive drum and a gap is formed between the abutting portion and the second outer circumferential portion.

6. The image forming apparatus according to claim 5, wherein the abutting portion abuts on the first outer circumferential portion on a downstream side of the main body side coupling portion and on an upstream side of the main body gear portion in a moving direction of the coupling gear which is moved from the coupling position to the decoupling position by the moving unit.

7. The image forming apparatus according to claim 5, wherein when a monochrome image is formed, the coupling gear rotates with the first outer circumferential portion being in contact with the abutting portion at the decoupling position.

8. The image forming apparatus according to claim 1, wherein when the coupling gear is located at the decoupling position, the main body gear portion and the main body gear are decoupled from each other.

9. An image forming apparatus comprising:

an image forming unit configured to form toner image in a monochrome image forming mode and in a color image forming mode, the image forming unit including a plurality of photosensitive drums (i) each of which is provided with a coupling configured to receive a driving force generated by a motor for rotating the photosensitive drums and (ii) configured to form each of yellow toner image, magenta toner image, cyan toner image, and black toner image on a different one of the plurality of photosensitive drums;

a transmitting mechanism (i) configured to transmit the driving force generated by the motor to the coupling provided with the photosensitive drum on which the black toner image is formed and (ii) configured to be able to transmit the driving force generated by the motor to the couplings provided with the photosensitive drums on which the yellow toner image, magenta toner image, and cyan toner image are formed, the transmitting mechanism including:

(a) a plurality of driving gears each of which form a part of a different one of transmitting pathways for transmitting the driving force to the couplings provided with the photosensitive drums on which the yellow toner image, magenta toner image, and cyan toner image are formed and each of which is configured to rotate by the driving force;

(b) a plurality of coupling gears each of which form a part of the different one of the transmitting pathways, each of the plurality of coupling gears including (i) a coupling portion configured to couple the coupling and (ii) a gear portion integrally molded with the coupling portion and configured to mesh with a corresponding one of the plurality driving gears; and (c) a plurality of supporting portions each of which is configured to support a different one of the plurality of coupling gears such that the coupling gear rotates about a rotational axis thereof and is movable in the direction of the rotational axis and such that a position of the coupling portion is closer to the coupling than the gear portion integrally molded with the coupling portion in the direction of the rotational axis; and an arrangement mechanism configured to move the coupling gears in the direction of the rotational axis , to arrange each of the coupling gears at a position where each of the coupling portions have been separated from each of the couplings for operation of the image forming unit in the monochrome image forming mode, and to arrange each of the coupling gears at a position where each of the coupling portions couples on each of the couplings for operation of the image forming unit in the color image forming mode.

10. The image forming apparatus according to claim 9, wherein the arrangement mechanism includes, a plurality of springs each of which is configured to urge the one of the coupling gears against a corresponding one of the couplings such that each of the coupling gears couples on the corresponding one of the couplings, a plurality of cam members each of which corresponds to the different one of the springs and includes a cam surface configured to press the coupling gear against a urging force generated by the spring such that the coupling gear moves from the position where the coupling portion couples on the coupling to the position where the coupling portion has been separated from the coupling by the spring contracting.

11. The image forming apparatus according to claim 10, wherein each of cam members is configured to rotate about the rotational axis, wherein the arrangement mechanism includes a slider configured to slide along a direction in which the plurality of cam members arranges and configured to rotate the plurality of cam members respectively, wherein each of the cam surfaces presses the coupling gear in conjunction with the slider sliding towards a first direction and each of the coupling portions thereby separating from the corresponding coupling, wherein each of the springs presses the coupling gear in conjunction with the slider sliding towards a second direction opposite to the first direction and each of the coupling portions thereby coupling the corresponding coupling.

12. The image forming apparatus according to claim 10 further comprising a plurality of bearing members each of which is disposed between one of the gear portions and a corresponding one of the couplings, each bearing member being configured to bear the coupling gear separated from the coupling and arranged at a most separated position from the coupling by receiving an action of the cam surface in the direction of the rotational axis.

13. The image forming apparatus according to claim 12, wherein each of the coupling gears includes a circumferential part of which an outer surface has a circular shape surrounding the rotational axis and a recess part disposed at a position (i) different in the direction of the rotational axis from a position of the circumferential part and (ii) closer to the gear portion than the circumferential part, wherein the recess part is configured to connect the circumferential part to the gear portion, and an outer surface of the recess part is more concave than the outer surface of the circumferential part in a direction perpendicular to the direction of the rotational axis, wherein the arrangement mechanism is configured to arrange each of the coupling gears for operation of the image forming unit in the monochrome image forming mode such that each of the circumferential parts is supported by the bearing member, and the arrangement mechanism is configured to arrange each of the coupling gears for operation of the image forming unit in the color image forming mode such that each of the circumferential parts retracts from a position for being supported by the bearing member and the recess part arranges at the position where the bearing member is provided in the direction of the rotational axis.

14. The image forming apparatus according to claim 9, wherein each of the gear portions meshes with the different one of the driving gear regardless of a position of each of the coupling gears from the position where each of the coupling portions couples on the couplings to a farthest position where each of the coupling portions separates from the couplings.

15. The image forming apparatus according to claim 14, wherein a tooth width of the gear portion included in each of the coupling gears is smaller than a tooth width of the driving gear with which the gear portion meshes in the direction of the rotational axis, and the arrangement mechanism is operable to move each of the coupling gears within a distance equal to the width of the driving gear with which the gear portion of each of the coupling gears meshes.

* * * * *